US009207576B2

(12) United States Patent
Kitagawa

(10) Patent No.: US 9,207,576 B2
(45) Date of Patent: Dec. 8, 2015

(54) TONER CONVEYING UNIT AND IMAGE FORMING APPARATUS INCLUDING THE SAME

(71) Applicant: KYOCERA Document Solutions Inc., Osaka (JP)

(72) Inventor: Hiroaki Kitagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/448,037

(22) Filed: Jul. 31, 2014

(65) Prior Publication Data

US 2015/0043945 A1 Feb. 12, 2015

(30) Foreign Application Priority Data

Aug. 7, 2013 (JP) ..... 2013-163758

(51) Int. Cl.
*G03G 15/08* (2006.01)
*G03G 15/01* (2006.01)

(52) U.S. Cl.
CPC ..... *G03G 15/0886* (2013.01); *G03G 15/01* (2013.01); *G03G 15/0879* (2013.01); *G03G 2215/0132* (2013.01); *G03G 2215/0692* (2013.01)

(58) Field of Classification Search
CPC ..... G03G 15/0879; G03G 15/0886
USPC ..... 399/260
See application file for complete search history.

(56) References Cited

U.S. PATENT DOCUMENTS

| | | | | |
|---|---|---|---|---|
| 7,684,730 | B2 * | 3/2010 | Furuta et al. | 399/121 |
| 8,229,318 | B2 * | 7/2012 | Nakajima et al. | 399/110 |
| 2009/0060586 | A1 * | 3/2009 | Ishiguro et al. | 399/238 |

FOREIGN PATENT DOCUMENTS

JP 2011-191618 A 9/2011

* cited by examiner

*Primary Examiner* — Clayton E LaBalle
*Assistant Examiner* — Leon W. Rhodes, Jr.
(74) *Attorney, Agent, or Firm* — Studebaker & Brackett PC

(57) ABSTRACT

A toner conveying unit includes a toner case, an intermediate unit, and a developing unit. The intermediate unit removably supports the toner case. The intermediate unit includes a toner inlet, a toner outlet, a toner conveying path and a shutter. The toner outlet discharges the toner received from the toner inlet toward the developing unit. The toner conveying path connects the toner inlet with the toner outlet. The shutter opens/closes the toner inlet and the toner outlet in linkage with an operation of attaching/detaching the toner case. The shutter integrally includes an inlet sealing member capable of opening/closing the toner inlet, and an outlet sealing member linked with the inlet sealing member and capable of opening/closing the toner outlet.

12 Claims, 7 Drawing Sheets

TONER CONVEYING UNIT AND IMAGE FORMING APPARATUS INCLUDING THE SAME

INCORPORATION BY REFERENCE

This application is based on and claims the benefit of priority from Japanese Patent application No. 2013-163758 filed on Aug. 7, 2013, the entire contents of which are incorporated herein by reference.

BACKGROUND

The present disclosure relates to a toner conveying unit and an image forming apparatus including the same suitably used in a copier, a printer and the like.

There is known an image forming apparatus including a toner case configured to store toner and an intermediate transfer unit provided between the toner case and a developing unit disposed below the toner case. The image forming apparatus adopting such electro-photographic technology is configured to form a color toner image by sequentially transferring each color toner image formed on a plurality of image carriers disposed in tandem to an intermediate transfer belt in the intermediate transfer unit. The image forming apparatus forms a color image on a sheet by transferring the color toner image on the intermediate transfer belt to the sheet.

There is also known an image forming apparatus including a toner cartridge including a shutter member or the like opening/closing a toner replenishing port and a sheet conveying belt (intermediate transfer belt) carrying a color toner image for example. Such image forming apparatus includes a toner conveying path for supplying toner from a toner case to a developing unit. This arrangement makes it possible to equalize length of the toner conveying paths and to suppress the apparatus from being enlarged.

However, although it is possible to close the replenishing port of the toner cartridge by the shutter member in replacing (removing) the toner cartridge, no consideration has been made on closing an upper opening (toner inlet) of the toner conveying path communicating with an upper opening of the developing unit or the developing unit in the image forming apparatus described above. In this case, because the toner inlet is always opened, toner flies from the toner inlet and contaminates around the toner inlet in removing/attaching the toner case.

The intermediate transfer unit in which the toner conveying path is formed also often requires to manually open/close a lower opening (toner outlet) of the toner conveying path in replacing the toner case. In such a case, a user is forced to separately carry out opening/closing operations of the toner inlet and toner outlet, and is unable to readily replace toner cases.

SUMMARY

A toner conveying unit according to one aspect of the present disclosure includes a toner case, an intermediate unit, and a developing unit. The toner case is configured to store toner. The intermediate unit removably supports the toner case. The developing unit is disposed under the toner case through the intermediate unit. The intermediate unit includes a toner inlet, a toner outlet, a toner conveying path and a shutter. The toner inlet receives the toner from the toner case. The toner outlet discharges the toner received from the toner inlet toward the developing unit. The toner conveying path connects the toner inlet with the toner outlet. The shutter opens/closes the toner inlet and the toner outlet in linkage with an operation of attaching/detaching the toner case. The shutter integrally includes an inlet sealing member capable of opening/closing the toner inlet, and an outlet sealing member linked with the inlet sealing member and capable of opening/closing the toner outlet.

An image forming apparatus according to one aspect of the present disclosure includes a toner conveying unit. The toner conveying unit includes a toner case, an intermediate unit, and a developing unit. The toner case is configured to store toner. The intermediate unit removably supports the toner case. The developing unit is disposed under the toner case through the intermediate unit. The intermediate unit includes a toner inlet, a toner outlet, a toner conveying path and a shutter. The toner inlet receives the toner from the toner case. The toner outlet discharges the toner received from the toner inlet toward the developing unit. The toner conveying path connects the toner inlet with the toner outlet. The shutter opens/closes the toner inlet and the toner outlet in linkage with an operation of attaching/detaching the toner case. The shutter integrally includes an inlet sealing member capable of opening/closing the toner inlet, and an outlet sealing member linked with the inlet sealing member and capable of opening/closing the toner outlet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Embodiments of the present disclosure will be described with reference to the drawings. It is noted that, in the following description, a front side of the color printer 1 is defined by an arrow Fr shown in the figures, for convenience.

Figure 1:
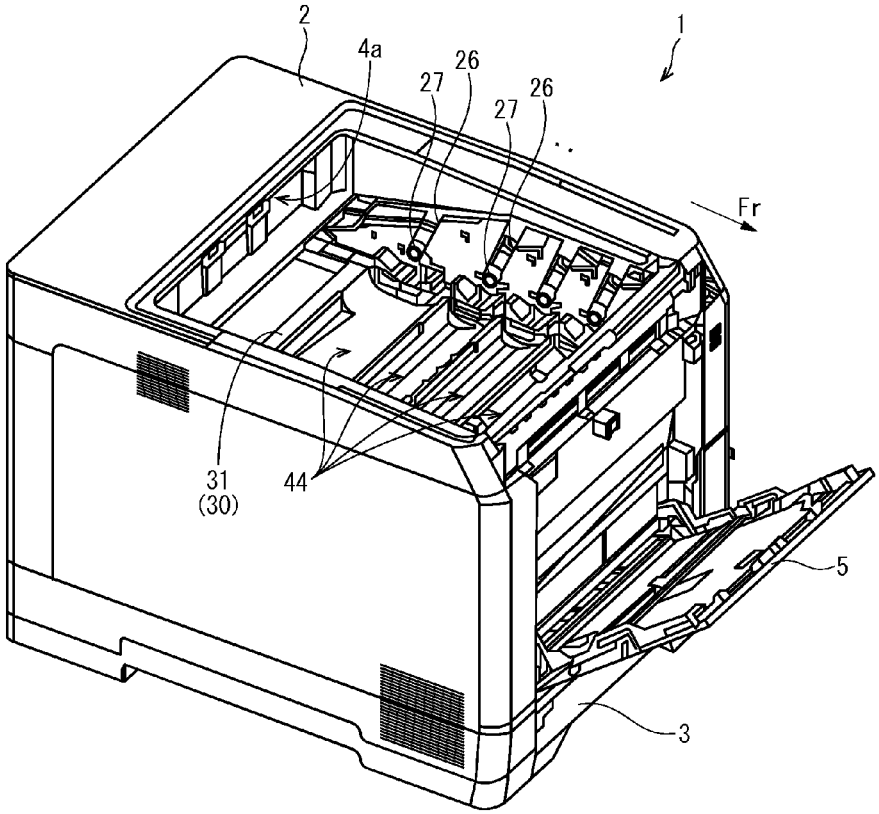
FIG. 1 is a perspective view showing a color printer according to one embodiment of the present disclosure in a state in which a top cover and each toner case are removed.
Figure 2:
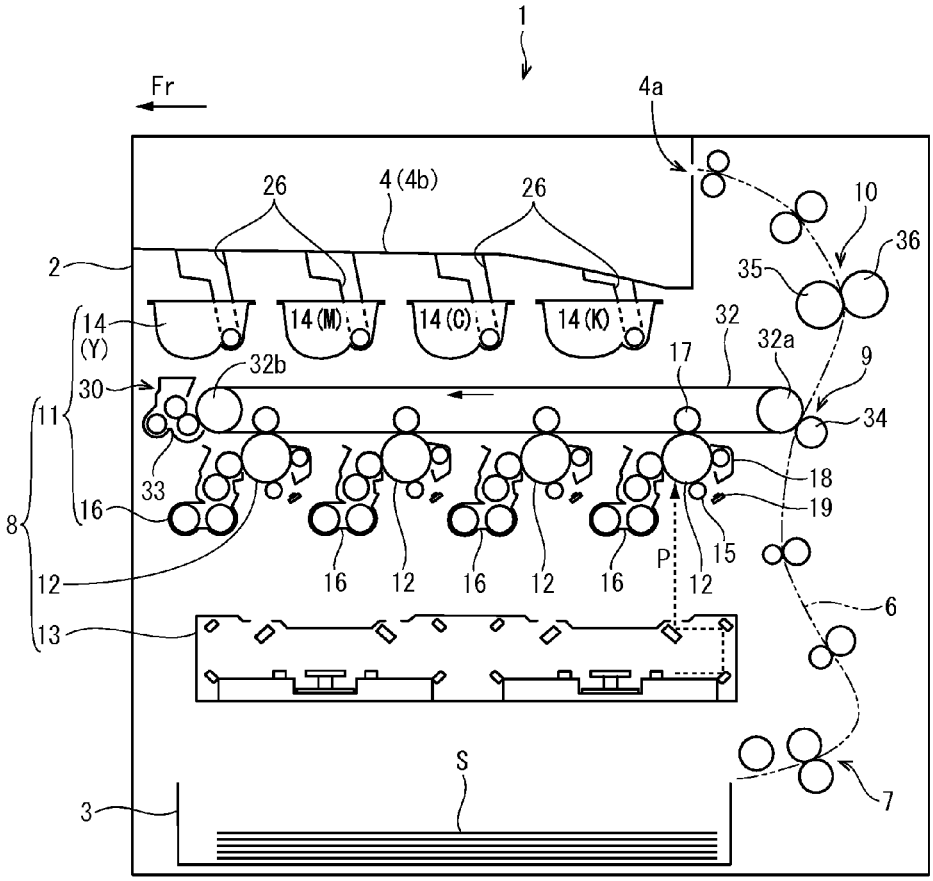
FIG. 2 is a sectional view schematically showing an internal structure of the color printer according to the embodiment of the present disclosure.
Figure 3:
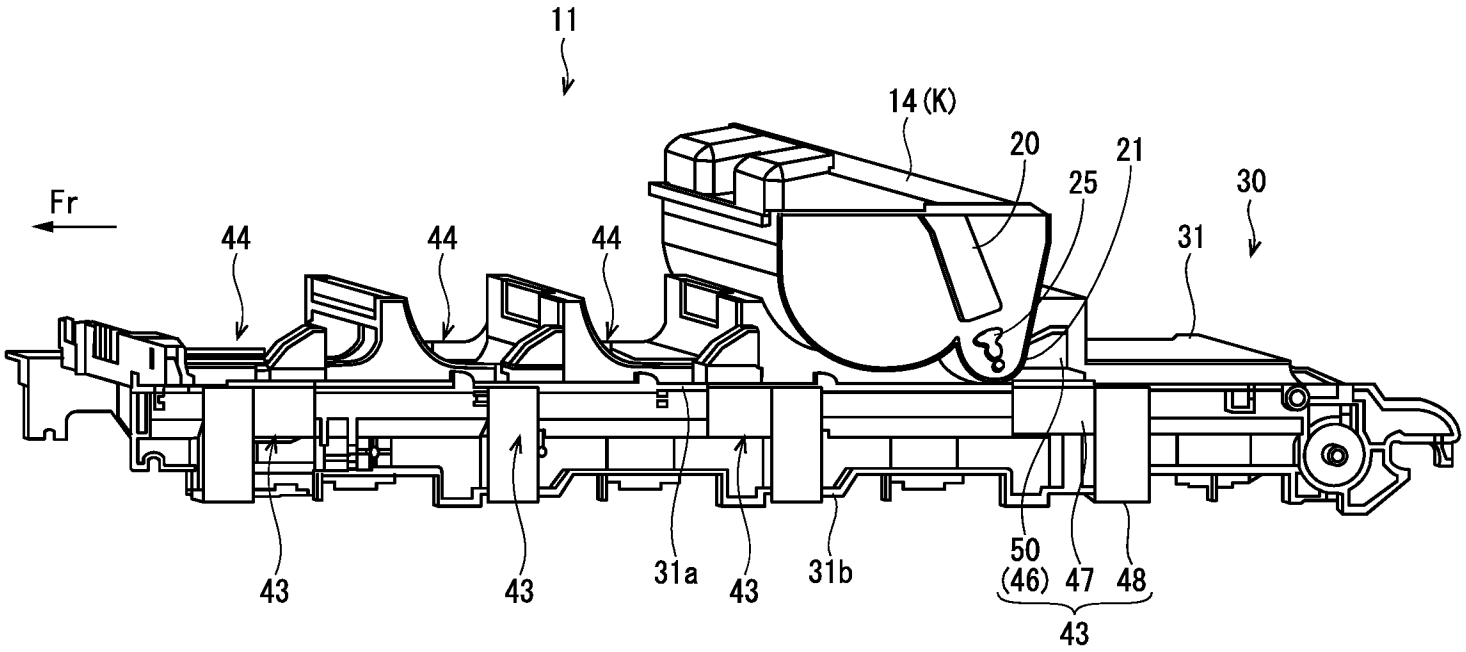
FIG. 3 is a perspective view illustrating a positional relationship of the toner cases and an intermediate transfer unit in the color printer of one embodiment of the present disclosure.
Figure 4:
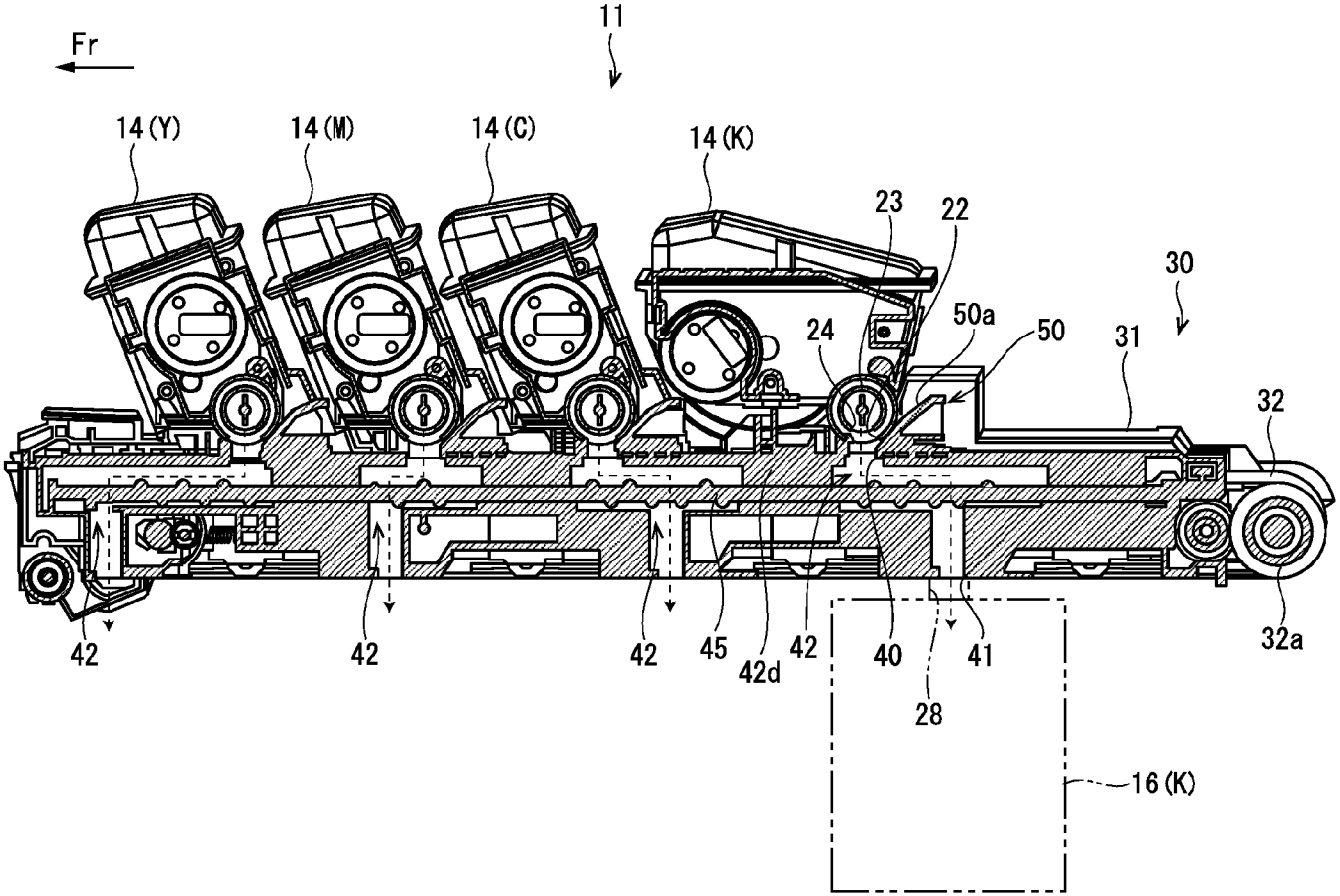
FIG. 4 is a side section view showing a toner conveying unit according to one embodiment of the present disclosure.

An entire configuration of a color printer 1, i.e., an image forming apparatus, will be described with reference to FIGS. 1 through 4. FIG. 1 is a perspective view showing the color printer 1 in a state in which a top cover 4*b* and each toner case 14 are removed. FIG. 2 is a sectional view schematically showing an internal structure of the color printer 1. FIG. 3 is a perspective view illustrating a positional relationship of the toner cases 14 and an intermediate transfer unit 30. FIG. 4 is a side section view showing a toner conveying unit 11.

As shown in FIG. 1, the color printer 1 includes a box-shaped printer body 2, a sheet feed cassette 3, a discharge tray 4, and a manual tray 5. The sheet feed cassette 3 is provided at a lower part of the printer body 2. The sheet feed cassette 3 is configured to store a sheet S. The discharge tray 4 is provided at an upper part of the printer body 2 (see FIG. 2). The discharge tray 4 receives the sheet S from a discharge port 4*a*. The manual tray 5 is provided at a front face of the printer body 2.

As shown in FIG. 2, a conveying path 6 extends vertically so as to connect the sheet feed cassette 3 with the discharge tray 4 at a rear part within the printer body 2. The color printer 1 also includes a sheet feed part 7, an image forming part 8, a secondary transfer part 9, and the fixing unit 10 within the printer body 2. The sheet feed part 7 is configured to supply the sheet S from the sheet feed cassette 3 to the conveying path 6. The image forming part 8 is configured to form a full-color toner image. The secondary transfer part 9 is configured to transfer the full-color toner image to the sheet S. The fixing unit 10 is configured to fix the toner image on the sheet S.

The image forming part 8 adopts a tandem type system in which image forming processes are carried out by using four color toners of yellow (Y), magenta (M), cyan (c) and black (K) for example. It is noted that those colors will be denoted by numerical values with (Y, M, C, K) in parenthesis only when it is necessary to specify the colors, and in a case where the colors are in common, those colors will be denoted only by numerical values.

The image forming part 8 includes a toner conveying unit 11, four photosensitive drums 12, i.e., image carriers, and an exposure unit 13. The exposure unit 13 irradiates a light flux beam (see an arrow P in FIG. 2) to a surface of each photosensitive drum 12.

The toner conveying unit 11 includes four toner cases 14, four developing units 16, and an intermediate transfer unit 30. The four toner cases 14 store toners to be replenished of each color (Y, M, C, and K), respectively. The four developing units 16 are disposed under the toner cases 14 corresponding to each color toner. The intermediate transfer unit 30 is disposed between the toner case 14 and the respective developing units 16.

Each toner case 14 is arrayed in a front-rear direction (in a direction in which an intermediate transfer belt 32 described later extends). Each toner case 14 is detachably supported above the intermediate transfer unit 30. Each toner case 14 can be replaced by opening a top cover 4*b* composing a bottom surface of the discharge tray 4 (see FIG. 1).

As shown in FIGS. 3 and 4, each toner case 14 is formed substantially into a shape of a box. It is noted that the toner case 14 storing the black (K) toner disposed at the rear end is formed to be larger than the toner cases 14 storing the other color toners. Each toner case 14 includes a convex strip part 20, a semi-cylindrical cylindrical part 21, a toner supplying opening 22, a cylindrical container side shutter 23, an inner opening 24, and an engage projection 25. The convex strip part 20 is provided so as to project on both right and left side faces of each toner case 14 and so as to extend in a vertical direction while slightly inclining forward. The cylindrical part 21 is formed at a lower rear part of each toner case 14. The toner supplying opening 22 is formed at a lower left face of the cylindrical part 21 (rear side in FIG. 1) so as to communicate with an inside of the toner case 14 (see FIG. 4).

The container side shutter 23 is provided turnably within each cylindrical part 21 to open/close the toner supplying opening 22. The inner opening 24 is formed so as to penetrate through an outer circumferential surface of each container side shutter 23. The engaging projection 25 is provided at an outer end surface of each container side shutter 23 (see FIG. 3). Each engage projection 25 is exposed on a left side surface of each toner case 14 and turns in a body with the container side shutter 23. The container side shutter 23 turns between an opened position where the inner opening 24 coincides with the toner supplying opening 22 and a closed position where the inner opening 24 is shifted from the toner supplying opening 22. It is noted that the container side shutter 23 is biased toward the closed position by a bias part not shown.

Meanwhile, the printer body 2 includes four sets of guide grooves 26 and concave body side couplings 27 as shown in FIGS. 1 and 2. The four sets of guide grooves 26 are provided concavely at inner side surfaces in the horizontal direction of the printer body 2 such that the guide grooves 26 extend vertically while slightly inclining forward. The toner case 14 is guided in removing/attaching the toner case 14 by engaging the pair of right and left convex strip parts 20 with the guide groove 26. The body side coupling 27 is provided at a lower end of the guide groove 26. Although a detailed explanation will be omitted here, the body side coupling 27 rotates in linkage with the opening/closing operation of the top cover 4*b*. Then, as the engaging projection 25 of the attached toner case 14 fits into the body side coupling 27, the container side shutter 23 turns and the toner supplying opening 22 is opened.

Each of the developing units 16 develops a toner image on a surface of the photosensitive drum 12 by using toner supplied from the toner case 14 by applying a developing bias. The developing unit 16 receives the replenished toner from the toner case 14 through the rectangular toner replenishing port 28 opened above (see FIG. 4). It is noted that FIG. 4 shows only the developing unit 16 (K) developing by using the black (K) toner.

Each of the toner cases 14 is removably attached at an upper side of the intermediate transfer unit 30. Each of the developing units 16 is disposed under the intermediate transfer unit 30 (see FIG. 4). The intermediate transfer unit 30 is composed of an endless intermediate transfer belt 32 as shown in FIG. 2. The intermediate transfer belt 32 is stretched across a driving roller 32*a* and a tension roller 32*b*. The driving roller 32*a* is supported rotatably at a rear end part of the case 31. The tension roller 32*b* is supported rotatably at a front end part of the case 31. The driving roller 32*a* is driven by a driving unit not shown and rotates the intermediate transfer belt 32 in a direction of an arrow shown in FIG. 2. It is noted that the belt cleaning unit 33 removing toner remaining on the surface of the intermediate transfer belt 32 is provided on the tension roller 32*b* side. The belt cleaning unit 33 is disposed so as to face the tension roller 32*b* interposing the intermediate transfer belt 32 therebetween.

As shown in FIG. 2, each of the photosensitive drums 12 is arrayed in parallel in a direction in which the intermediate transfer belt 32 extends downstream the intermediate transfer belt 32. The photosensitive drum is provided to be rotatable. The charger 15, the developing unit 16, the primary transfer roller 17, the cleaning unit 18, and a destaticizing unit 19 are disposed around the photosensitive drum 12 in order of a primary transfer of process.

Each of the charging units 15 electrifies the surface of the photosensitive drum 12 by applying a charging bias. The primary transfer roller 17 is disposed so as to face the photosensitive drum 12 while interposing the intermediate transfer belt 32 therebetween. The primary transfer roller 17 is configured to primarily transfer the toner image on the photosensitive drum 12 to the intermediate transfer belt 32 by applying a transfer bias. The cleaning unit 18 is in sliding contact with the surface of the photosensitive drum 12 and removes the toner remaining on the surface of the photosensitive drum 12. The destaticizing unit 19 removes the charge of the intermediate transfer belt 32 after the primary transfer.

The exposure unit 13 deflect-scans the beam light flux irradiated from a plurality of light sources corresponding to each photosensitive drum 12 by a deflector such as a polygon mirror. The exposure unit forms an image of the beam light flux on the photosensitive drum 12.

The secondary transfer part 9 includes the sheet feed part 7 and the fixing unit 10 along the conveying path 6. The secondary transfer part 9 is composed of the driving roller 32*a* described above and a secondary transfer roller 34. The secondary transfer roller 34 is disposed so as to face the driving roller 32*a* while interposing the intermediate transfer belt 32 therebetween. The secondary transfer roller 34 is pressure contact with the driving roller 32*a* through the intermediate transfer belt 32. The secondary transfer roller 34 secondarily transfers the toner image on the intermediate transfer belt 32 to the sheet S by a secondary transfer bias applied thereto.

The fixing unit 10 includes a heating roller 35 and a pressure roller 36. The heating roller 35 is disposed on a side of the sheet S to which the toner image has been transferred. The pressure roller 36 is disposed so as to face the heating roller 35. The toner image formed on the surface of the sheet S melts as it comes into contact with the heating roller 35. The toner image is fixed by being pressed by the pressure roller 36 from a back of the sheet S.

Next, an image forming operation of the color printer 1 will be described. When the color printer 1 is turned ON, various parameters are initialized and initial settings such as setting of temperature of the fixing unit 10 are executed. Image data is inputted from a computer or the like connected to the color printer 1, and the color printer 1 executes the image forming operation as follows in response to an instruction of Print Start.

At first, the charger 15 electrifies the surface of the photosensitive drum 12. The exposure unit 13 exposes the photosensitive drum 12 corresponding to the image data. Thereby, an electrostatic latent image is formed on the surface of the photosensitive drum 12. The electrostatic latent image is developed as a toner image of each color by each developing unit 16. The toner image is primarily transferred to the intermediate transfer belt 32 by the primary transfer roller 17 to which the primary transfer bias has been applied. These operations are repeated sequentially per each color and a full-color toner image is formed on the intermediate transfer belt 32. It is noted that the cleaning unit 18 and the destaticizing unit 19 remove the toner and charge remaining on the surface of the photosensitive drum 12.

Meanwhile, the sheet S taken out of the sheet feed cassette 3 (or the manual tray5) by the sheet feed part 7 is conveyed to the secondary transfer part 9 in synchronism with the toner image forming operation. The full-color toner image is secondarily transferred to the sheet S by the secondary transfer roller 34 to which the secondary transfer bias has been applied. The toner image secondarily transferred is fixed to the sheet S by the fixing unit 10. The sheet S on which the toner image has been fixed is discharged to the discharge tray 4 from the discharge port 4*a*. It is noted that the belt cleaning unit 33 removes toner remaining on the surface of the intermediate transfer belt 32 after the second transfer.

Figure 5:
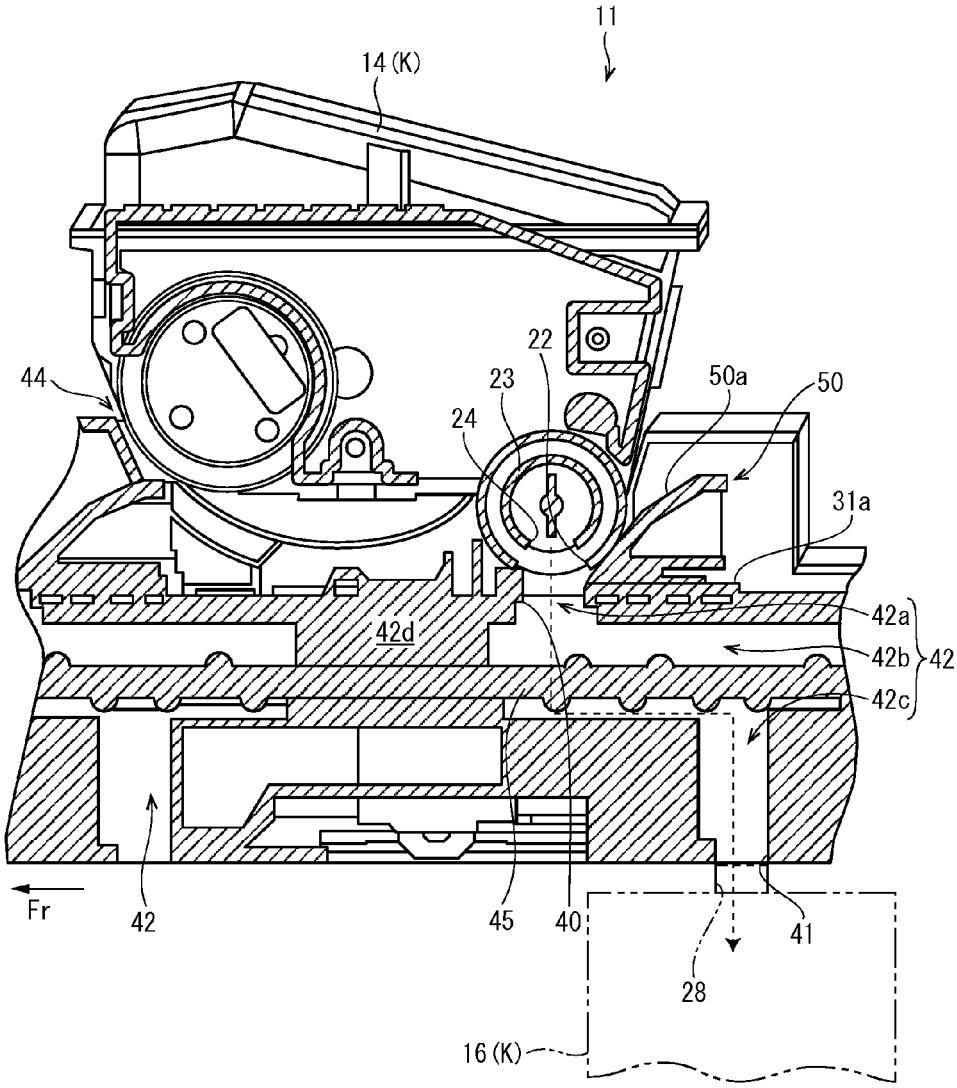
FIG. 5 is a side section view showing a part of the toner conveying unit of one embodiment of the present disclosure.
Figure 6:
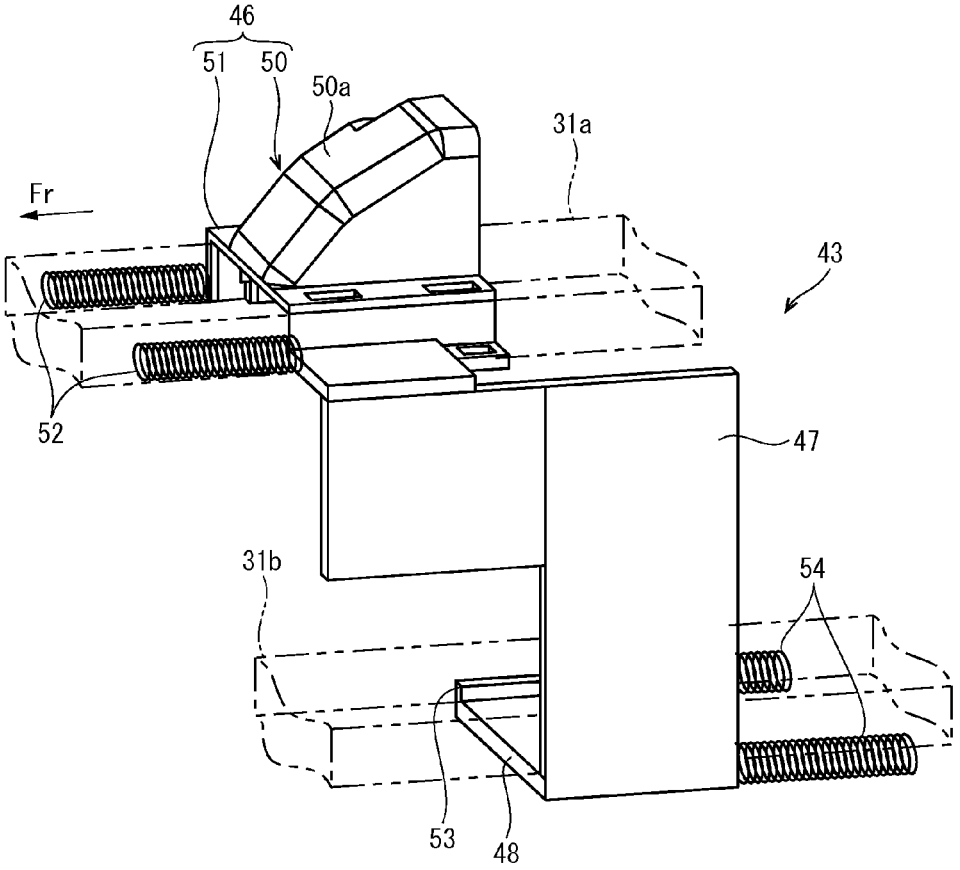
FIG. 6 is a perspective view showing a shutter of the toner conveying unit of one embodiment of the present disclosure.

Next, the intermediate transfer unit 30, i.e., the intermediate unit, will be described with reference to FIGS. 3 through 6. FIG. 5 is a side section view showing a part of the toner conveying unit 11. FIG. 6 is a perspective view showing a shutter 43.

As shown in FIGS. 3 and 4, the intermediate transfer unit 30 includes the intermediate transfer belt 32, four toner inlets 40, four toner outlets 41, four toner conveying paths 42, and four shutters 43. The intermediate transfer belt 32 is supported so as to be able to travel by a substantially rectangular-plate like case 31. The four toner inlets 40 receive toner from the respective toner cases 14. The four toner outlets discharge the toner received from the respective toner inlets 40 to the respective developing units 16. The four toner conveying paths 42 connect the toner inlets 40 with the toner outlets 41, respectively. The four shutters 43 open/close the toner inlets and the toner outlets.

Four mount parts 44 for mounting each toner case 14 are provided at an upper surface of the case 31. The four mount parts 44 are provided in parallel in the direction in which the intermediate transfer belt 32 extends (in the front-rear direction). Each mount part 44 is formed concavely so as to match with a lower surface (circumferential surface) of the toner case 14.

As shown in FIG. 4, the four toner inlets 40 are disposed at widthwise one end (the rear side in FIG. 1) on the upper surface of the case 31. The four toner inlets 40 open side by side in the direction in which the intermediate transfer belt 32 extends. Each toner inlet 40 is a rectangular opening and is formed at a position corresponding to each mount part 44. The four toner outlets 41 are disposed at widthwise one end of a lower surface of the case 31. The four toner outlets 41 open side by side in the direction in which the intermediate transfer belt 32 extends. Each toner outlet 41 is a rectangular opening and is formed at a position shifted in the front-rear direction to the corresponding toner inlet 40. Specifically, the front two toner outlets 41 (for the yellow (Y) and magenta (M) toners) are shifted forward from the corresponding toner inlets 40 and the rear two toner outlets 41 (for the cyan (C) and black (K) toners) are shifted rearward from the corresponding toner inlets 40.

As shown in FIGS. 4 and 5, the toner conveying path 42 is formed into a shape of a crank by an inlet side vertically path 42*a*, a horizontal path 42*b* and an outlet side vertically path 42*c*. The inlet side vertically path 42*a* extends substantially vertically downward from the toner inlet 40. The horizontal path 42*b* is orthogonal to the inlet side vertically path 42*a* and extends substantially horizontally toward each corresponding toner outlet 41. The outlet side vertically path 42*c* is orthogonal to the horizontal path 42*b* and extends substantially vertically downward toward each toner outlet 41. A barrier wall 42*d* is formed between the adjacent toner conveying paths 42. The barrier wall 42*d* prevents mixture of the toners transferred through the respective toner conveying paths 42. A toner conveying screw 45 is disposed rotatably within the case 31. The toner conveying screw 45 is provided so as to penetrate through horizontal paths 42*b* of all of the toner conveying paths 42. The toner conveying screw 45 is rotationally driven by a driving unit not shown and moves toner introduced from each toner inlet 40 to each toner outlet 41.

As shown in FIGS. 3 and 6, each shutter 43 is integrally forming while including an inlet sealing member 46 and an outlet sealing member 48. The inlet sealing member 46 opens/closes the toner inlet 40. The outlet sealing member 48 is linked to the inlet sealing member 46 through a link member 47 and opens/closes the toner outlet 41. It is noted that because the four shutters 43 have the similar configuration, respectively, only the shutter for the black (K) toner will be noticed and explained hereinafter.

As shown in FIG. 6, the inlet sealing member 46 includes a cam part 50 and an inlet side guide portion 51. The cam part 50 has a cam face 50*a* inclining downward toward the front side. The cam part 50 is formed substantially into a shape of triangular column. The inlet side guide portion 51 is provided at a lower side of the cam part 50 and is formed substantially into a shape of U whose lower part is opened when viewed from the front. The inlet side guide portion 51 slidably engages with an inlet side rail part 31*a* formed at an upper part of the case 31. Accordingly, the shutter 43 moves while being guided by the inlet side guide portion 51.

A pair of right and left inlet side bias members 52 is provided in the inlet sealing member 46. The pair of right and left inlet side bias members 52 biases the shutter 43 in a direction of closing the toner inlet 40 and the toner outlet 41 (front direction in the present embodiment). Each of the pair of right and left inlet side bias members 52 is a so-called coil spring. The two inlet side bias members 52 are disposed on both right and left sides along the inlet side rail part 31*a*. A rear end part of each inlet side bias member 52 is anchored to a front end part of the inlet side guide portion 51. A front end part of each inlet side bias member 52 is anchored to the case 31.

The link member 47 is a thin plate continuously provided at a left end part of the inlet side guide portion 51. The link member 47 is formed substantially into a shape of L when viewed from the side along the toner conveying path 42.

An outlet sealing member 48 is formed into a shape of a thin plate. The outlet sealing member 48 extends in the right direction from a lower end part of the link member 47. An outlet side guide part 53 extending upward is formed at an extending edge (right end part) of the outlet sealing member 48. The outlet side guide part 53 slidably engages with the outlet side rail part 31*b* formed at a lower part of the case 31. More specifically, the shutter 43 moves while being guided as the outlet side rail part 31*b* is interposed between the outlet side guide part 53 and the lower part of the link member 47.

A pair of right and left outlet side bias members 54 is provided in the outlet sealing member 48. The pair of right and left outlet side bias members 54 biases the shutter 43 in a direction of opening the toner inlet 40 and the toner outlet 41 (rear direction in the present embodiment). Each of the outlet side bias members 54 is a so-called coil spring. The two outlet side bias members 54 are disposed on both right and left sides along the outlet side rail part 31*b*. A front end part of the outlet side bias member 54 is anchored to a rear end part of each outlet side bias member 54 and a rear end part of the outlet side bias member 54 is anchored to the case 31. A bias force of each outlet side bias member 54 is set to be weaker than a bias force of each inlet side bias member 52. Thereby, the shutter 43 is always biased in the direction of closing the toner inlet 40 and the toner outlet 41.

Figure 7A:
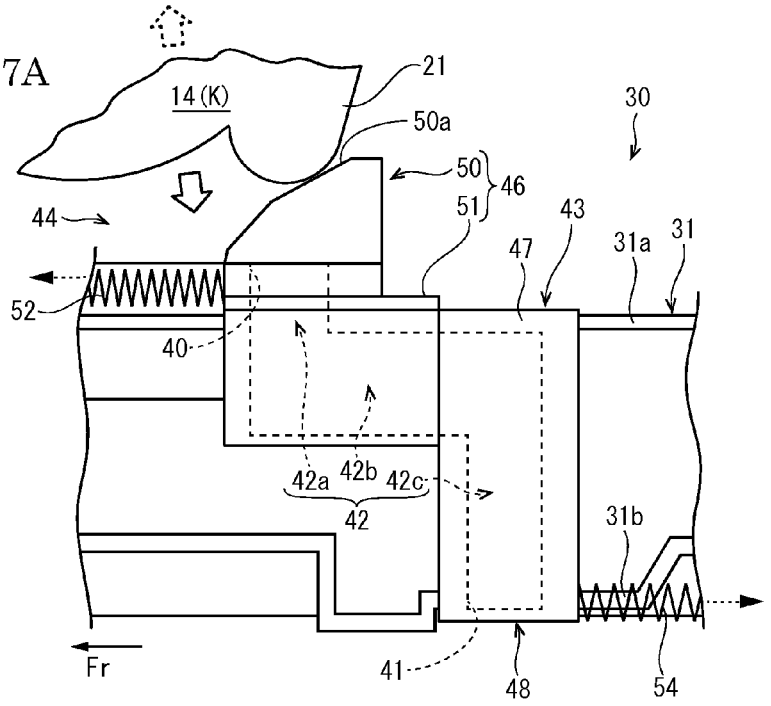
FIG. 7A is a side view showing the toner conveying unit of one embodiment of the present disclosure in which the shutter is closed.
Figure 7B:
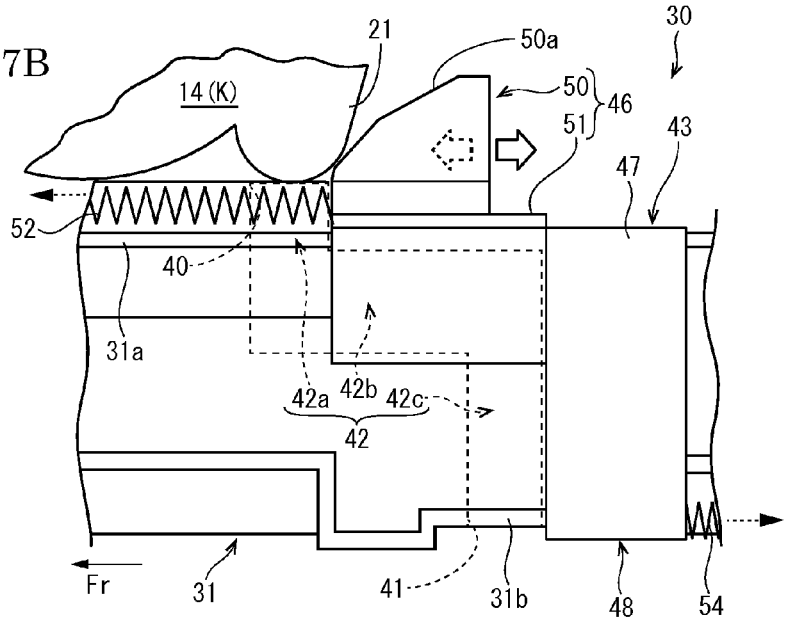
FIG. 7B is a side view showing the toner conveying unit of one embodiment of the present disclosure in which the shutter is opened.

Next, an operation of the toner conveying unit 11 will be described with reference to FIG. 7. Specifically, an operation of attaching/detaching each toner case 14 to/from each mount part 44 and an operation of opening/closing the toner conveying path 42 (the toner inlet 40 and the toner outlet 41) made by the shutter 43 in linkage with the attaching/detaching operation will be explained. FIG. 7A is a side view showing the shutter 43 in a closed state, and FIG. 7B is a side view showing the shutter 43 in an opened state. It is noted that the toner case 14 for the black (K) toner will be continuously noticed and explained.

Firstly, a case of attaching the toner case 14 to the intermediate transfer unit 30 will be explained. For instance, the user opens the top cover 4*b* (see FIG. 1). The user puts the convex strip part 20 of the toner case 14 into the guide groove 26 and moves the toner case 14 downward along the guide groove 26 (see a solid blanked arrow in FIG. 7A). In this process, the cylindrical part 21 of the toner case 14 comes into contact with the cam face 50*a* of the cam part 50 of the inlet sealing member 46 (see FIG. 7A).

When the downward move of the toner case 14 advances further, the cylindrical part 21 slides relatively above the cam face 50*a* and the shutter 43 slides rearward by resisting against the bias force of each inlet side bias member 52 (see a solid blanked arrow in FIG. 7B) That is, the cam part 50 abuts against the cylindrical part 21 during the process of the operation of attaching the toner case 14 to the toner inlet 40, and moves the shutter 43. The shutter 43 moves in the direction of opening the toner inlet 40 and the toner outlet 41 by resisting against the bias force of each inlet side bias member 52.

At this time, the bias force of each outlet side bias member 54 supports the move of the shutter 43 in the direction of opening the toner inlet 40 and the toner outlet 41. This arrangement makes it possible to stabilize the move of the shutter 43 linked with the operation of attaching the toner case 14.

In the same time, the engaging projection 25 of the toner case 14 fits into the body side coupling 27. Thus, the toner case 14 is attached to the attaching part 44. After that, in linkage with an operation of the user closing the top cover 4*b*, the body side coupling 27 turns. The container side shutter 23 turns together with the engaging projection 25 due to the turn of the body side coupling 27. Thereby, the container side shutter 23 moves from the closed position to the opened position. In this state, the inner opening 24, the toner supplying opening 22 and the toner inlet 40 coincide, respectively (see FIG. 5). That is the toner inlet 40 is opened. Meanwhile, concurrently with opening of the toner inlet 40, the toner outlet 41 is also opened. The toner replenishing port 28 provided at an upper part of the developing unit 16 is connected to the opened toner outlet 41 (see FIG. 5).

Thereby, the replenishing toner from the toner case 14 is put into the toner inlet 40 of the intermediate transfer unit 30 through the inner opening 24 and the toner supplying opening 22. As shown by an arrow indicated by a broken line in FIG. 5, the replenishing toner is passed to the developing unit 16 by passing through the toner conveying path 42 and through the toner outlet 41 and the toner replenishing port 28.

Next, a case of removing the toner case 14 out of the intermediate transfer unit 30 will be explained. For instance, if the user opens the top cover 4*b*, the body side coupling 27 turns in linkage with this opening operation. The container side shutter 23 turns from the opened position to the closed position together with the engaging projection 25 due to the turn of the body side coupling 27. In this state, the toner supplying opening 22 of the toner case 14 is closed by the container side shutter 23. It is noted that a bias member not shown supports the turn of the container side shutter 23 toward the closed position.

In succession, when the user moves the toner case 14 along the guide groove 26, the engaging projection 25 of the toner case 14 is detached from the body side coupling 27. In the same time, the attachment (engagement) of the cylindrical part 21 of the toner case 14 with the cam part 50 (the cam face 50*a*) is released. The toner case 14 is removed in a sequence reverse to that in attaching the toner case 14 described above. Specifically, along with the upward move of the toner case 14, the shutter 43 slides forward by the bias force of the inlet side bias member 52 (see a blanked arrow indicated by a broke line in FIG. 7B). That is, the shutter 43 closes the toner inlet 40 and the toner outlet 41 in linkage with the operation of detaching the toner case 14. It is noted that because the bias force of the outlet side bias member 54 is set to be weaker (smaller) than the bias force of the inlet side bias member 52, the shutter 43 moves in the direction of closing the toner inlet 40 and the toner outlet 41 by the bias force of the inlet side bias member 52.

In this state, the toner inlet 40 is closed by the inlet sealing member 46, and the toner outlet 41 is sealed by the outlet sealing member 48 (see FIG. 7A). Then, the user detaches the convex strip part 20 from the guide groove 26 and takes the toner case 14 out of the printer body 2 (see a blank arrow indicated by a broken line in FIG. 7A).

It is noted that the opening/closing operation (turn) of the container side shutter 23 is linked with the operation of opening/closing the top cover 4*b* in the present embodiment, the present disclosure is not limited to such configuration. For instance, the container side shutter 23 may be opened/closed manually by the user by separately manipulating a lever.

According to the color printer 1 (the toner conveying unit 11) of the present embodiment described above, each shutter 43 is formed integrally by connecting the inlet sealing member 46 and the outlet sealing member 48. Due to that, the toner inlet 40 and the toner outlet 41 are opened substantially in the same time in linkage with the operation of attaching the toner case 14. Meanwhile, the toner inlet 40 and the toner outlet 41 are closed substantially in the same time in linkage with the operating of detaching the toner case 14. This arrangement makes it possible to effectively prevent the toner from flying from the toner inlet 40 and the toner outlet 41 in replacing the toner case 14. It is also possible to automatically open/close the toner inlet 40 and the toner outlet 41 by the simple manipulation of attaching/detaching the toner case 14.

According to the color printer 1 (the toner conveying unit 11) of the present embodiment, the operation of attaching the toner case 14 is steadily linked with the move of the shutter 43 in the closing direction by using the cam mechanism (the cam part 50 and the cylindrical part 21 of the toner case 14). The shutter 43 also smoothly slides by being guided by the inlet side rail part 31*a* and the outlet side rail part 31*b*. This arrangement makes it possible to open/close the toner inlet 40 and the toner outlet 41 swiftly and adequately by the shutter 43.

It is noted that the outlet side bias member 54 may be omitted if the shutter 43 is configured to smoothly slide with respect to the case 31.

It is also noted that while the toner conveying path 42, the shutter 43 and others are provided in the intermediate transfer unit 30 for primarily transferring a toner image, the present disclosure is not limited to such configuration. For instance, an intermediate hopper for temporarily storing toner supplied from the toner case 14 may be applied in the present disclosure. In this case, the toner conveying path 42, the shutter 43 and others are disposed in the intermediate hopper, i.e., an intermediate unit. Still further, the toner conveying path 42 functions also as a toner conveying path and a space for temporarily storing the toner.

A number of the disposed toner cases 14 (and a number of disposed toner conveying paths 42) is not also limited to four, and any number may be set in accordance to uses of the apparatus. For instance, the present disclosure is applicable also to a monochromatic image forming apparatus. In this case, an intermediate unit from which the intermediate transfer belt 32 is omitted from the intermediate transfer unit 30 is used.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment.

What is claimed is:

1. A toner conveying unit comprising:

a toner case storing toner;

an intermediate unit removably supporting the toner case; and a developing unit disposed under the toner case through the intermediate unit;

the intermediate unit including:

a toner inlet receiving the toner from the toner case;

a toner outlet discharging the toner received from the toner inlet toward the developing unit;

a toner conveying path connecting the toner inlet with the toner outlet; and a shutter opening/closing the toner inlet and the toner outlet in linkage with an operation of attaching/detaching the toner case;

wherein the shutter is formed integrally by connecting an inlet sealing member and an outlet sealing member;

the inlet sealing member is capable of opening/closing the toner inlet; and the outlet sealing member is capable of opening/closing the toner outlet.

2. The toner conveying unit according to claim 1, further comprising an inlet side bias member provided in the inlet sealing member and biasing the shutter in a direction of closing the toner inlet and the toner outlet.

3. The toner conveying unit according to claim 2, further comprising an outlet side bias member provided in the outlet sealing member and biasing the shutter in a direction of opening the toner inlet and the toner outlet;

wherein a bias force of the outlet side bias member is set to be weaker than a bias force of the inlet side bias member.

4. The toner conveying unit according to claim 2, further comprising a cam part provided in the inlet sealing member, abutting against the toner case in a process of attaching the toner case, and moving the shutter in the direction of opening the toner inlet and the toner outlet by resisting against the bias force of the inlet side bias member;

an inlet side guide part provided in the inlet sealing member, slidably engaging with an inlet side rail part formed in the intermediate unit, and guiding the movement of the shutter; and an outlet side guide part provided in the outlet sealing member, slidably engaging with an outlet side rail part formed in the intermediate unit, and guiding the movement of the shutter.

5. The toner conveying unit according to claim 1, wherein the toner conveying path is formed into a shape of a crank;

the shutter includes a link member liking the inlet sealing member with the outlet sealing member; and the link member is formed along the toner conveying path.

6. The toner conveying unit according to claim 1, wherein a plurality of toner cases is provided per each color of toners;

the developing units are provided corresponding to each color toner; and the intermediate unit is disposed between each of the toner cases and each of the developing units.

7. An image forming apparatus comprising:

a toner conveying unit including:

a toner case storing toner;

an intermediate unit removably supporting the toner case; and a developing unit disposed under the toner case through the intermediate unit;

the intermediate unit including:

a toner inlet receiving the toner from the toner case;

a toner outlet discharging the toner received from the toner inlet toward the developing unit;

a toner conveying path connecting the toner inlet with the toner outlet; and a shutter opening/closing the toner inlet and the toner outlet in linkage with an operation of attaching/detaching the toner case;

wherein the shutter is formed integrally by connecting an inlet sealing member and an outlet sealing member;

the inlet sealing member is capable of opening/closing the toner inlet; and the outlet sealing member is capable of opening/closing the toner outlet.

8. The image forming apparatus according to claim 7, further comprising an inlet side bias member provided in the inlet sealing member and biasing the shutter in a direction of closing the toner inlet and the toner outlet.

9. The image forming apparatus according to claim 8, further comprising an outlet side bias member provided in the outlet sealing member and biasing the shutter in a direction of opening the toner inlet and the toner outlet;

wherein a bias force of the outlet side bias member is set to be weaker than a bias force of the inlet side bias member.

10. The image forming apparatus according to claim 8, further comprising a cam part provided in the inlet sealing member, abutting against the toner case in a process of attaching the toner case, and moving the shutter in the direction of opening the toner inlet and the toner outlet by resisting against the bias force of the inlet side bias member;

an inlet side guide part provided in the inlet sealing member, slidably engaging with an inlet side rail part formed in the intermediate unit, and guiding the movement of the shutter; and an outlet side guide part provided in the outlet sealing member, slidably engaging with an outlet side rail part formed in the intermediate unit, and guiding the movement of the shutter.

11. The image forming apparatus according to claim 7, wherein the toner conveying path is formed into a shape of a crank;

the shutter includes a link member liking the inlet sealing member with the outlet sealing member; and the link member is formed along the toner conveying path.

12. The image forming apparatus according to claim 7, wherein a plurality of toner cases is provided per each color of toners;

the developing units are provided corresponding to each color toner; and the intermediate unit is disposed between each of the toner cases and each of the developing units.

* * * * *